US008062155B2

(12) United States Patent
Butcher

(10) Patent No.: US 8,062,155 B2
(45) Date of Patent: Nov. 22, 2011

(54) ARROWHEAD HAVING BOTH FIXED AND MECHANICALLY EXPANDABLE BLADES

(75) Inventor: Robert Butcher, Flushing, MI (US)

(73) Assignee: Eastman Outdoors Inc., Flushing, MI (US)

( * ) Notice: Subject to any disclaimer, the term of this patent is extended or adjusted under 35 U.S.C. 154(b) by 441 days.

(21) Appl. No.: 12/052,999

(22) Filed: Mar. 21, 2008

(65) Prior Publication Data

US 2008/0234079 A1 Sep. 25, 2008

Related U.S. Application Data

(60) Provisional application No. 60/896,663, filed on Mar. 23, 2007.

(51) Int. Cl.
*F42B 6/08* (2006.01)

(52) U.S. Cl. ..... 473/582; 473/578; 473/583; 473/584

(58) Field of Classification Search ..... 473/578, 473/582–584

See application file for complete search history.

(56) References Cited

U.S. PATENT DOCUMENTS

| | | | | | |
|---|---|---|---|---|---|
| 2,909,372 | A | * | 10/1959 | Neri | 473/584 |
| 3,578,328 | A | * | 5/1971 | Rickey | 473/583 |
| 3,756,600 | A | * | 9/1973 | Maleski | 473/584 |
| 3,887,186 | A | * | 6/1975 | Matlock, Jr. | 473/584 |
| 4,099,720 | A | * | 7/1978 | Zeren | 473/584 |
| 4,166,619 | A | * | 9/1979 | Bergmann et al. | 473/581 |
| 4,349,202 | A | * | 9/1982 | Scott | 473/584 |
| 4,452,460 | A | * | 6/1984 | Adams | 473/584 |
| 4,468,038 | A | * | 8/1984 | Saunders | 473/584 |
| 4,615,529 | A | * | 10/1986 | Vocal | 473/583 |
| 4,928,969 | A | * | 5/1990 | Nagatori | 473/584 |
| 4,940,246 | A | * | 7/1990 | Stagg | 473/583 |
| 4,974,859 | A | * | 12/1990 | Briesemeister | 473/584 |
| 4,976,443 | A | * | 12/1990 | DeLucia | 473/583 |
| 4,998,738 | A | * | 3/1991 | Puckett | 473/583 |
| 5,046,744 | A | * | 9/1991 | Eddy | 473/583 |
| 5,066,021 | A | * | 11/1991 | DeLucia | 473/583 |
| 5,082,292 | A | * | 1/1992 | Puckett et al. | 473/583 |
| 5,090,709 | A | * | 2/1992 | Johnson | 473/584 |
| 5,145,187 | A | * | 9/1992 | Lewis | 473/584 |
| 5,178,398 | A | * | 1/1993 | Eddy | 473/583 |
| 5,178,399 | A | * | 1/1993 | Garoutte | 473/584 |
| 5,192,081 | A | * | 3/1993 | Cooper | 473/584 |
| 5,322,297 | A | | 6/1994 | Smith | |
| 5,458,341 | A | * | 10/1995 | Forrest et al. | 473/583 |
| 5,472,213 | A | * | 12/1995 | Dudley | 473/583 |
| 5,496,042 | A | * | 3/1996 | Craft et al. | 473/583 |
| 5,564,713 | A | * | 10/1996 | Mizek et al. | 473/583 |
| 5,803,844 | A | | 9/1998 | Anderson | |

(Continued)

*Primary Examiner* — Gene Kim
*Assistant Examiner* — Alexander Niconovich
(74) *Attorney, Agent, or Firm* — The Weintraub Group, P.L.C.

(57) ABSTRACT

An improved arrowhead features two sets of expandable blades. The expandable blades are pivotally movable from a first, concealed position to a second expanded position when spurs on the front of the blades contact a target. The first concealed position of the blades allows the arrowhead to penetrate the target upon contact. The fixed blades may be diamond-shaped, double-edged replaceable blades. The expandable blades comprise at least two pivotable blades that can be held in the first safe position by an elastic band. The spurs are located at a first end of the expandable blades, and these spurs are located proximate the base of the fixed blade portion of the arrow head, to allow the fixed portion to penetrate the target before the expandable blades are deployed by the spurs contacting the target.

20 Claims, 8 Drawing Sheets

U.S. PATENT DOCUMENTS 5,803,845 A * 9/1998 Anderson ..... 473/583
5,820,498 A * 10/1998 Maleski ..... 473/584
5,857,930 A * 1/1999 Troncoso ..... 473/583
5,879,252 A * 3/1999 Johnson ..... 473/583
5,931,751 A * 8/1999 Cooper ..... 473/583
5,941,784 A * 8/1999 Mizek ..... 473/584
6,015,357 A * 1/2000 Rizza ..... 473/583
6,077,180 A * 6/2000 Adams, Jr. ..... 473/584
6,165,086 A * 12/2000 Liechty, II ..... 473/583
6,171,206 B1 * 1/2001 Liechty, II ..... 473/583
6,174,252 B1 * 1/2001 Mizek ..... 473/583
6,217,467 B1 * 4/2001 Maleski ..... 473/583
6,258,000 B1 * 7/2001 Liechty, II ..... 473/583
6,283,880 B1 * 9/2001 Barrie ..... 473/584
6,287,223 B1 * 9/2001 Liechty, II ..... 473/583
6,287,224 B1 * 9/2001 Liechty, II ..... 473/584
6,306,053 B1 * 10/2001 Liechty, II ..... 473/583
6,322,464 B1 * 11/2001 Sestak ..... 473/583
6,398,676 B1 * 6/2002 Mizek ..... 473/583
6,428,433 B1 * 8/2002 Liechty, II ..... 473/583
6,428,434 B1 * 8/2002 Liechty, II ..... 473/583
6,554,727 B1 * 4/2003 Armstrong et al. ..... 473/584
6,595,881 B1 * 7/2003 Grace et al. ..... 473/583
6,663,518 B1 * 12/2003 Kuhn ..... 473/583
6,726,581 B2 * 4/2004 Muller ..... 473/583
6,755,758 B2 * 6/2004 Liechty, II ..... 473/583
6,758,774 B2 * 7/2004 Liechty, II ..... 473/589
6,793,596 B1 * 9/2004 Sullivan et al. ..... 473/583
6,830,523 B1 * 12/2004 Kuhn ..... 473/583
6,939,258 B2 * 9/2005 Muller ..... 473/583
7,207,908 B1 * 4/2007 Gizowski ..... 473/583
7,377,869 B2 * 5/2008 Wohlfeil et al. ..... 473/583
7,485,056 B2 * 2/2009 Sullivan et al. ..... 473/583
7,713,152 B1 * 5/2010 Tentler et al. ..... 473/583
7,951,024 B2 * 5/2011 Mizek ..... 473/583
2001/0006916 A1 * 7/2001 Liechty, II ..... 473/583
2002/0065155 A1 * 5/2002 Liechty, II ..... 473/583
2002/0098926 A1 * 7/2002 Liechty, II ..... 473/583
2003/0073525 A1 * 4/2003 Liechty, II ..... 473/583
2004/0092342 A1 * 5/2004 Perkins, Sr. ..... 473/583
2004/0142778 A1 * 7/2004 Mizek et al. ..... 473/583
2004/0198540 A1 * 10/2004 Mizek et al. ..... 473/583
2005/0130774 A1 * 6/2005 Wohlfeil et al. ..... 473/583
2006/0052191 A1 * 3/2006 Mizek et al. ..... 473/583
2007/0078034 A1 * 4/2007 Maleski ..... 473/583
2008/0045363 A1 * 2/2008 Pulkrabek ..... 473/583
2008/0254925 A1 * 10/2008 Odabachian et al. ..... 473/584
2008/0261734 A1 * 10/2008 Cooper ..... 473/584
2009/0111621 A1 * 4/2009 Mizek ..... 473/584
2009/0233742 A1 * 9/2009 Sanford ..... 473/584
2010/0222164 A1 * 9/2010 Butcher ..... 473/583

* cited by examiner

FIG. 1A
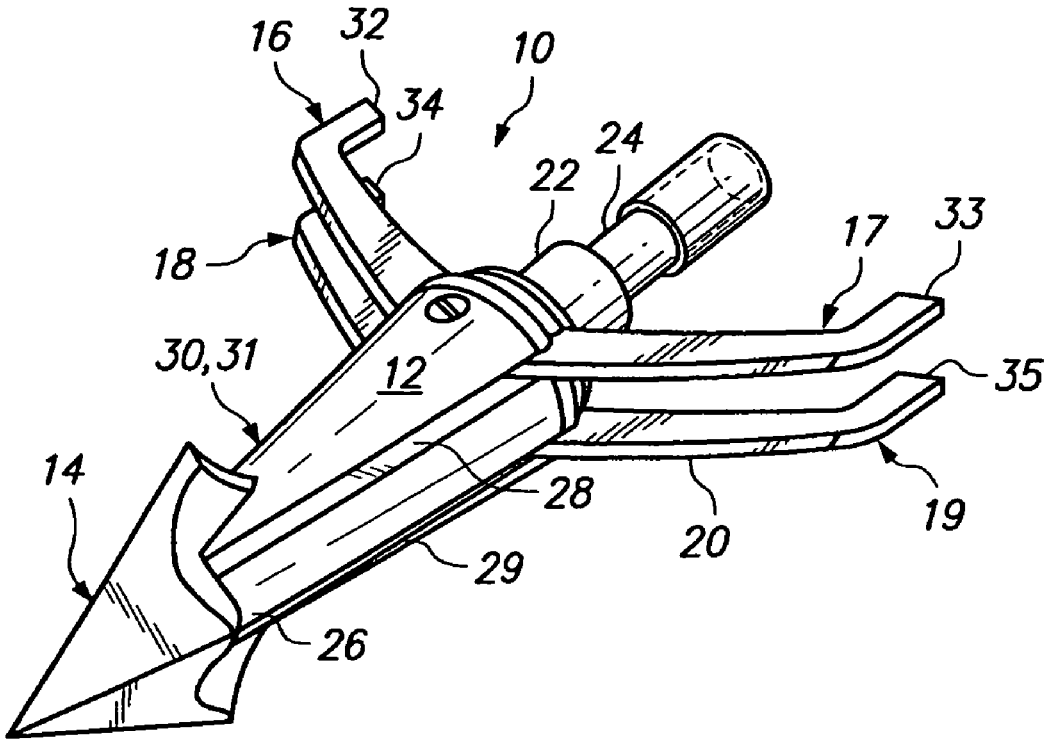
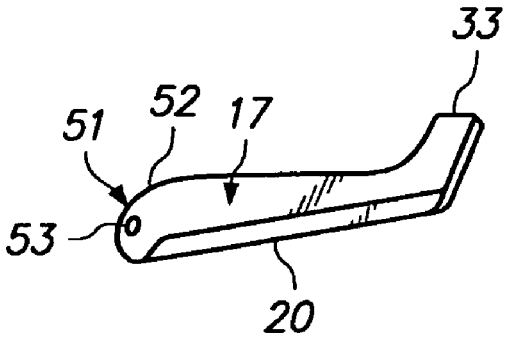
FIG. 1B

ARROWHEAD HAVING BOTH FIXED AND MECHANICALLY EXPANDABLE BLADES

CROSS REFERENCE TO RELATED APPLICATIONS

This application claims the benefit of U.S. Provisional Application No. 60/896,663, filed 23 Mar. 2007. The entire disclosure of the referenced provisional application is incorporated by reference herein.

BACKGROUND OF THE INVENTION

1. Field of the Invention

The present invention relates to arrowheads, used in connection with arrows, for the sport of archery or for hunting. More particularly, the present invention relates to a mechanically expandable broadhead having a single fixed, deflection-resistant spear-point blade at the tip thereof, in combination with multiple pivotally movable blades.

2. Description of the Background Art

People in the field of archery or bow hunting commonly use arrowheads for:

(1) preserving the integrity of an arrow; (2) maintaining an accurate arrow flight pattern; and (3) creating a more effective means of harvesting game.

In the past, to maintain the integrity of an arrow, some type of metal has been provided at the arrow tip. Metals used for arrowhead manufacture include stainless steel and steel alloys. Titanium is also becoming fairly common in arrow tip manufacture.

While almost any metal arrowhead would suffice to preserve an arrow's structural integrity, one objective, among arrowhead makers, is to create an arrowhead that both maintains an accurate flight pattern, and maximizes the effectiveness of a strike, to allow the bow-hunting enthusiast to efficiently harvest game. An arrowhead with relatively small blades provides accurate arrow flight, but offers a less effective or efficient means of harvesting game. In contrast, an arrowhead with large blades gives the arrow a less effective flight pattern, but provides for a more effective strike and harvest.

Today, selected hunters and some archery enthusiasts use mechanically expandable broadhead-type arrowheads. The expandable blade arrowhead offers a combination of both accurate arrow flight and effective harvest ability, in a single arrowhead. Expandable blade arrowheads tend to be accurate during flight, since the arrowhead remains small in diameter. Upon contact with the target or game, the arrowhead expands in diameter as large blades spring open, creating a larger area of penetration, and consequently, a more effective harvest. In this type of arrowhead, expansion of the blades, from a stored position to a fully deployed position, is caused by the mechanical action of the arrowhead striking the target.

Several inventors have independently patented different designs for mechanically expandable arrowheads.

U.S. Pat. No. 4,940,246 to Stagg (1990) discloses a mechanically expandable arrow attachment and/or arrowhead in which two actuator members protrude from opposite sides of a cylindrical central body. When the arrowhead of Stagg strikes a target, the actuator members open integrally attached cutting blades, which are initially folded into the central body. During deployment of the cutting blades, the actuator members move through the cylindrical body and emerge on the opposite side.

While the Stagg reference discloses the combination of a fixed arrow tip with mechanically expandable blades, the actuator members of Stagg are spaced significantly away from the fixed tip, requiring significant entry depth of the fixed tip into a target before the mechanical blades begin to expand. In addition, in the design of Stagg, the actuator members are located relatively close to the pivot point, providing a relatively small lever arm to pivotally move the blade.

U.S. Pat. No. 5,178,398 to Eddy (1993) discloses another use of expandable blades. A rubber band is positioned over two expandable blades, to keep the blades closed during an arrow's flight. The band's position also prohibits the opening of the blades until the arrowhead penetrates its target, as the blades must break the band to expand.

U.S. Pat. No. 5,803,848 to Anderson (1998) uses a tip-actuated method of deploying two retractable blades. However, in typical hunting conditions it is possible that debris could collect in the actuator lip of the arrowhead of this design, limiting the effectiveness of the arrow.

U.S. Pat. No. 6,015,357 to Rizza (2000) contains two opposed blades that can either remain stationary or become expandable, depending on the consumer's desired use.

Several arrowhead patents have been issued with expandable blades retained by an annular member, such as an O-ring or rubber band, during flight. U.S. Pat. No. 5,322,297 to Smith (1994), U.S. Pat. No. 5,564,713 to Mizek et al. (1996) and U.S. Pat. No. 5,879,252 to Johnson (1999) all contain expandable blades retained by an annular member; however, none of these arrowheads contain a fixed-in-place blade, to ensure that the arrowhead retains some level of effectiveness, in the event that the expandable blades fail to deploy.

U.S. Pat. No. 6,554,727 to Armstrong et al. discloses another expandable blade arrowhead.

It has been discovered that if the known expandable blade arrowheads do not hit directly on a solid target area, or if they strike a target at an angle, these arrows may become deflected rather than entering into the target. Expandable blade arrowheads have been known to "bounce off" or ricochet away from the target in some instances. In addition, expandable arrowheads of the known type may have a greater tendency to bounce off than standard arrows, because of the requirement of the target causing the blades to open mechanically.

While the known arrowheads have some utility for their intended purposes, a need remains for improvement in the arrowhead art. A need exists for an arrowhead having multiple parallel expandable blades, in which actuators for the expandable blades are situated close to a fixed blade at the tip of the arrowhead, in order to minimize the time between entry of the fixed blade and the beginning of deployment of the expandable blades.

SUMMARY OF THE INVENTION

The present invention provides an improved arrowhead, which features two sets of mechanically expandable blades, and which also includes a "cut-on-contact" spear-point blade, fixedly mounted at the tip of the arrowhead, to provide entry into the target before the expandable blades are deployed, in order to resist deflection of the arrowhead.

In the arrowhead according to a first embodiment of the present invention, expandable blade actuator spurs are situated close to a fixed blade at the tip of the arrowhead, in order to minimize the time between entry of the fixed blade and the beginning of deployment of the expandable blades.

An arrowhead, according to the first embodiment, includes a support body having a substantially conical tip portion, with a central slot formed therein to receive the fixed spear-point blade. The support body also has dual sets of longitudinal slots formed in the sides thereof, which allows it to serve as a housing for two spaced-apart sets of pivotally attached expandable blades.

At the base of the support body, a threaded shaft may be provided to allow the arrowhead to be threadably and rotatably mounted in a threaded bore at the front of an arrow shaft. Alternatively, a hollow shaft with a threaded female bore formed therein is provided to threadably and rotatably mount on a threaded stud at an end of an arrow shaft.

The expandable blades are disposed in a semi-retracted configuration during arrow flight, with actuator spurs extending outwardly from the support body, proximate the base of the fixed blade.

The fixed spear-point blade may be a substantially diamond-shaped double-edged fixed blade, attached to the front of the support body in the central slot, between the expandable blades, to form the leading edge of the arrow tip. Alternatively, the fixed blade may be formed in another shape. The cutting edges of the fixed blade may be flat and continuous, or may alternatively be made serrated. If desired, the spear-point blade may be three-dimensionally configured so that a longitudinally central portion thereof is thickened and is wider than a medial edge portion thereof.

Each blade is attached by a suitable fastener, which closely conforms to the exterior surface of the support body, to minimize wind resistance during flight. The fastener may be made removable, in order to allow the blades to be replaced, should they become damaged or worn. As noted, the arrowhead according to the first embodiment of the invention includes at least two sets of pivotally movable and expandable blades, for a total of four movably expandable blades. These blades may each be made substantially parallel to an adjacent blade disposed on the same side of the support body.

The fastener for attaching the fixed front spear-point blade to the support body may be a screw. In one exemplary embodiment, the fastener fits into a threaded bore, formed substantially transversely to the longitudinal axis of the support body. Optionally, the fastener may also pass through a pre-cut hole provided in the spear-point blade, to retain the spear-point blade in fixed relation to the support body.

Where two sets of expandable blades are used, each set of two blades may be fastened to the support body with a single fastener. Alternatively, each of the expandable blades may be separately fastened to the support body.

Each of the fasteners, selected to interconnect one or more of the expandable blades to the support body, operates in a dual capacity. First, the fastener attaches one or more of the expandable blades to the support body. Second, it operates as the fulcrum on which the expandable blade pivots to its opened state.

During arrow flight, and when not in use, the expandable blades may be retained in the closed configuration thereof by an elastic band or O-ring.

Each of the expandable blades includes a small, yet highly functional spur, which is situated at or near the leading edge of the expandable blade when it is in its closed or retracted configuration. The spurs extend outwardly beyond the support body while the blades are in the closed position. In an illustrative embodiment hereof, in the closed configuration of the arrowhead, the spurs are situated at the forward most end of the expandable blades, adjacent the fixed blade at the tip of the support body.

The spurs' purpose is two-fold. First, the spurs help provide stability in the arrow's flight as they counter-balance the wind shear of the fixed blade; and second, upon the arrowhead's contact with the target, the spur impacts against the target surface, forcing the blade rearward. This rearward movement of the blades either breaks the elastic retaining ring or moves it rearward on the arrow shaft. Once the pivotally attached blades expand, the bases of the blades anchor against the support body slot, orienting the sharp cutting edges of the blades facing forwardly, to provide the maximum effective cutting surface.

It is an object of the present invention to provide a mechanically expandable broadhead that also includes a fixed blade at the tip portion thereof.

It is a further object of the invention to provide a mechanically expandable broadhead of the type described, in which a plurality of actuator spurs are located close to the fixed blade, to provide quick opening of the expandable blades shortly after the tip enters a target.

For a more detailed presentation of the invention, the following section offers a detailed description accompanied by drawings. Throughout the following detailed description and drawings, like numbers refer to like parts.

BRIEF DESCRIPTION OF THE DRAWINGS

FIG. 1A is a perspective view of an expandable blade arrowhead according to a selected illustrative embodiment of the invention, in an open configuration thereof, taken from a vantage point in front of the arrowhead;

FIG. 1B is a detail perspective view of one expandable blade which is a component of the arrowhead of FIG. 1A;

DETAILED DESCRIPTION OF ILLUSTRATIVE EMBODIMENTS

Figure 2:
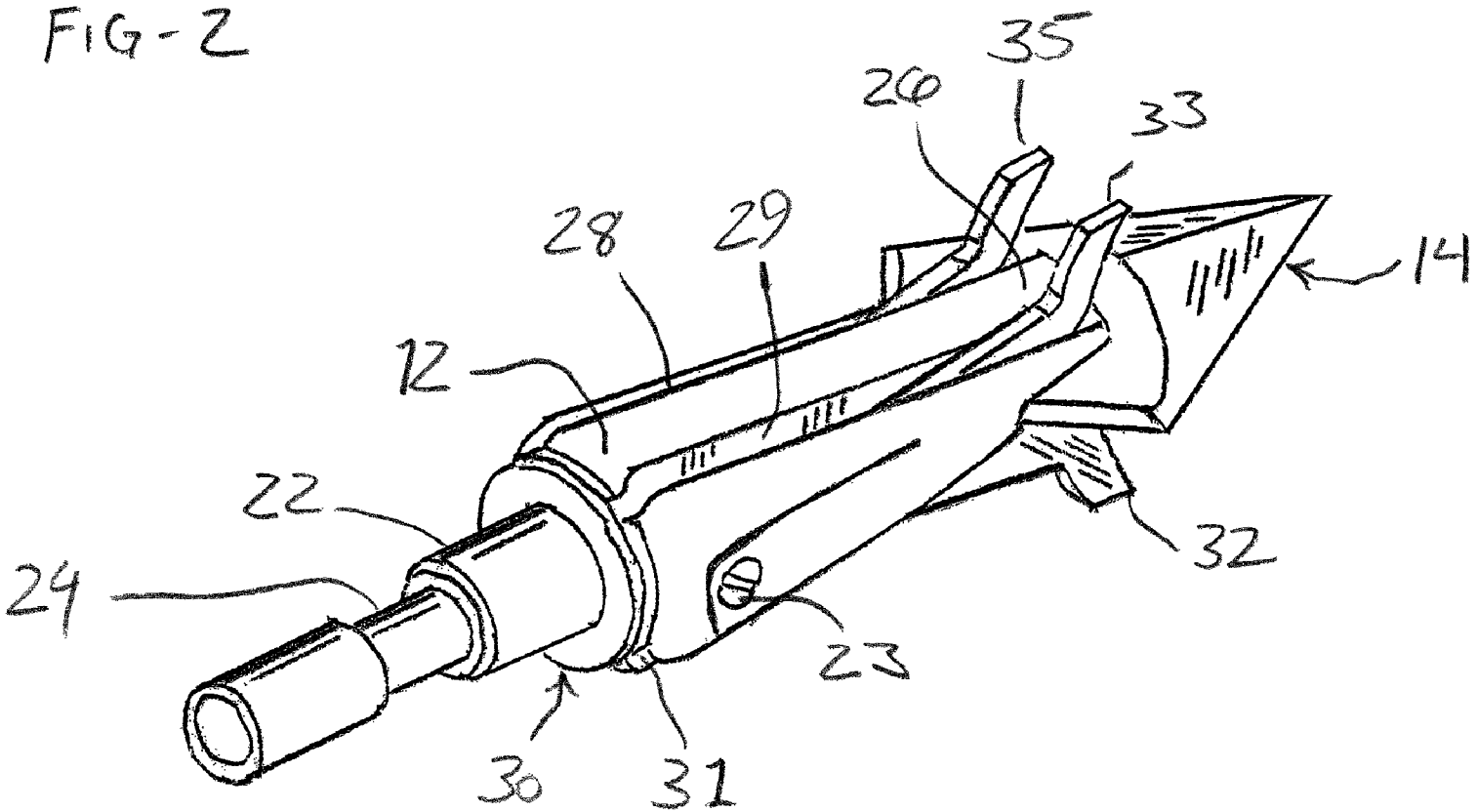
FIG. 2 is a perspective view of the expandable blade arrowhead of FIG. 1, shown in a closed configuration thereof, taken from a vantage point in back of the arrowhead, with the arrowhead rotated 90 degrees about a longitudinal axis from the orientation shown in FIG. 1.
Figure 3:
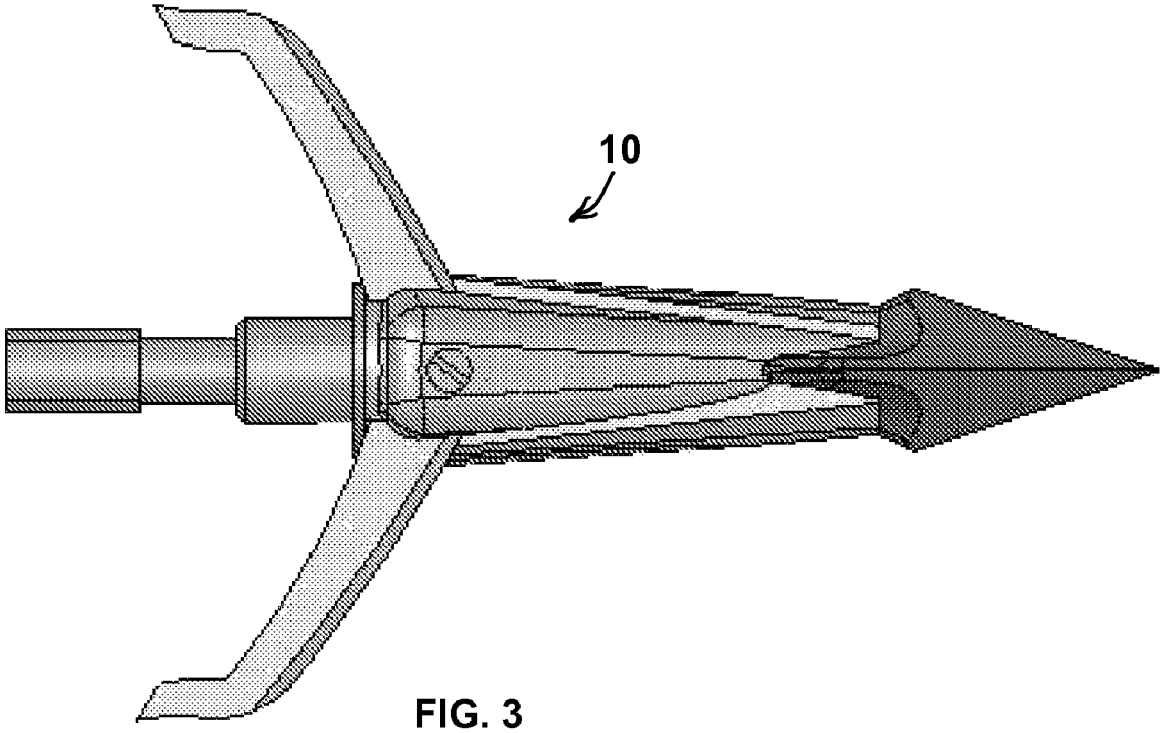
FIG. 3 is a top plan view of the arrowhead of FIG. 1, with the expandable blades shown in the open position.

Referring to FIGS. 1A, 1B and 2 of the drawings, an expandable blade broadhead-type arrowhead, according to a first embodiment of the invention, is shown generally at 10. The arrowhead 10 includes a support body 12, which supports a fixed blade 14, and two pairs of substantially parallel opposed, pivotally mounted blades 16, 17, 18, and 19. Optionally, the arrowhead 10 may also be provided with a stretchable rubber or elastic retaining ring (not shown) to temporarily keep the expandable blades in the closed position during storage and flight.

The support body 12 includes a base 22, which has an integral threaded 24 thereon for use in mounting the arrowhead 10 on an arrow shaft (not shown). The support body 12 also includes a substantially conical tip 26 opposite the base 22. The base 22 may be made of a larger diameter than the area of the support body adjacent the tip 26, for aerodynamic purposes, and for ease of entry of the support body 12 into a target.

The support body 12 makes up the main central structure of the arrowhead 10, and can be made from stainless steel, steel alloy, titanium, or other metal, depending on the desired weight.

The support body 12 will be made from these various materials, to provide archery enthusiasts and hunters with the specific weight grain (mass) for their desired application depending on the type of target and distance.

In the depicted embodiment, the support body 12 has two pairs of substantially parallel opposed side slots 28, 29, 30, and 31 formed in the respective sides thereof, to accommodate the four semi-concealed expandable blades 16, 17, 18, and 19, respectively.

The support body also has an inwardly tapered tip 26 at the front end thereof, with a center slot 29 formed therethrough to receive the fixed blade 14.

Figure 4:
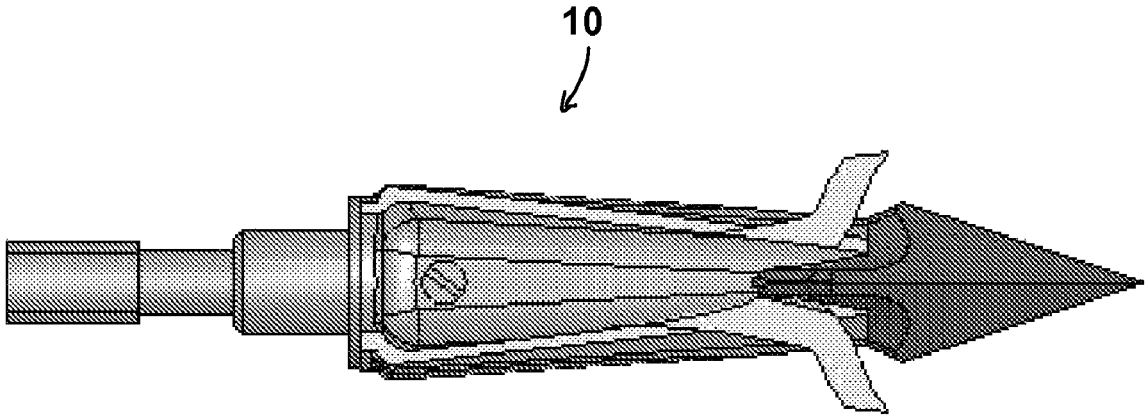
FIG. 4 is a top plan view of the arrowhead of FIG. 1, with the expandable blades shown in the closed position.
Figure 5:
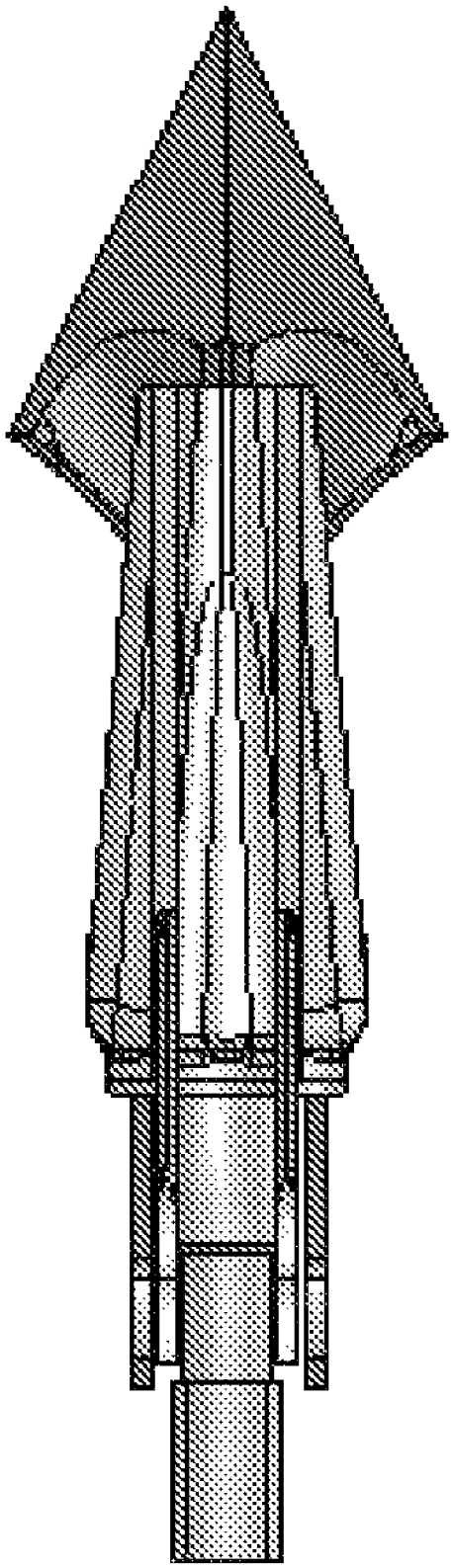
FIG. 5 is a side plan view of the arrowhead of FIG. 1, with the expandable blades shown in the open position.
Figure 6:
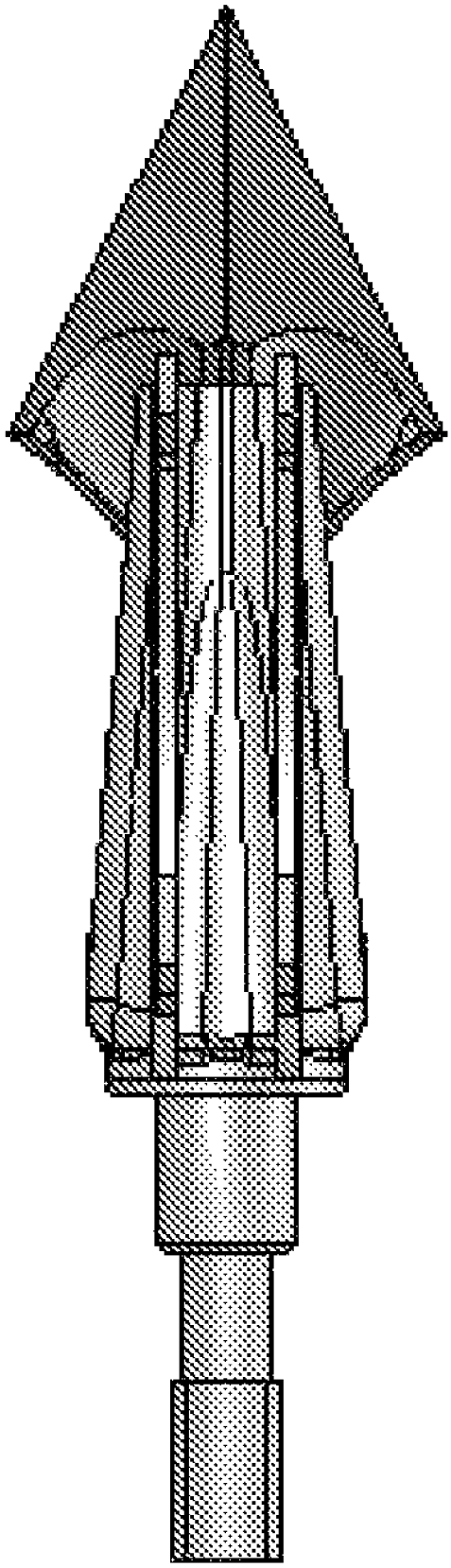
FIG. 6 is a side plan view of the arrowhead of FIG. 1, with the expandable blades shown in the closed position.

By slotting the support body 12, thus semi-concealing the expandable blades 16, 17, 18, and 19 in the side slots 28, 29, 30, and 31 in their closed or retracted configuration shown in FIGS. 2 and 4, the arrow's aerodynamics are improved. The expandable blades 16, 17, 18 and 19 have sharpened edges on the leading edges 20 that face inwardly in the side slots 28, 29, 30, and 31 of the support body 12, while the blades are in the closed or retracted position. Placement of the respective sharpened edges of the expandable blades 16, 17, 18 and 19 within the slots 28, 29, 30, and 31 during storage and transport of the arrowhead 10 protects the sharpened edges from damage, oxidation, and/or premature wear. This also enables a hunter or archery enthusiast to carefully handle the arrowhead 10, with the blades closed, and to rotatably attach the arrowhead to an arrow shaft with reduced risk of being cut.

The expandable blades 16, 17, 18 and 19 are sharpened on both the top and bottom surfaces of the cutting edges 20 thereof, to ensure maximum cutting ability. This sharpening creates machined surfaces adjacent the cutting edges 20.

In the practice of the present invention, the arrowhead 10 is constructed and arranged so that when the expandable blades 16, 17, 18 and 19 are in the closed configuration thereof, the portion of each of the expandable blades behind and exclusive of its respective spur 32, 33, 34 and 35 tapers inwardly as it moves rearwardly from the spur end towards the pivotally attached end thereof. This is a reflection of the fact that in the closed configuration, the expandable blades 32, 33, 34 and 35 are oriented so that part of the machined portion thereof, proximate the spur, is visible, as shown in FIGS. 2 and 4. As a result, it will be understood that the expandable blades 16, 17, 18 and 19 are oriented to deploy and open quickly when the arrowhead 10 strikes a target. In one embodiment hereof, the fixed blade 14 and the expandable blades 16, 17, 18 and 19 are all made of stainless steel.

Each of the expandable blades 16, 17, 18 and 19 is also equipped with a respective spur 32, 33, 34 and 35 at a freely movable end thereof. The spurs 32, 33, 34 and 35 act as lever arms, to force open the expandable blades 16, 17, 18 and 19, and to move the retaining ring (where used) rearward on the support body 12, when the arrowhead 10 strikes a target. The spurs 32, 33, 34 and 35 may have pointed tips, as shown.

In the closed configuration of the blades 16, 17, 18 and 19 shown in FIG. 2, the spurs 32, 33, 34 and 35 are situated at or near a forward-most leading edge of the blades near the fixed blade 14 at the tip 26 of the support body 12, and the spurs extend outwardly away from the support body, as shown. This forward-facing location of the spurs 32, 33, 34 and 35 is significant, because it enables the expanding blades 16, 17, 18 and 19 to begin their deployment shortly after the fixed blade 14 penetrates into a target.

Each of the expandable blades 16, 17, 18 and 19 respectively, has a hole 53 formed through a rounded end thereof, opposite the spur. These inner ends of the blades are rounded in order to allow free rotation of the blades around a pivot point provided by a mounting fastener 23, as will be further described herein. The rounded end 51 of each respective blade 16, 17, 18 and 19 may include a flat portion 52 provided to act as a stop, so as to limit rearward movement of the blade.

Figure 8:
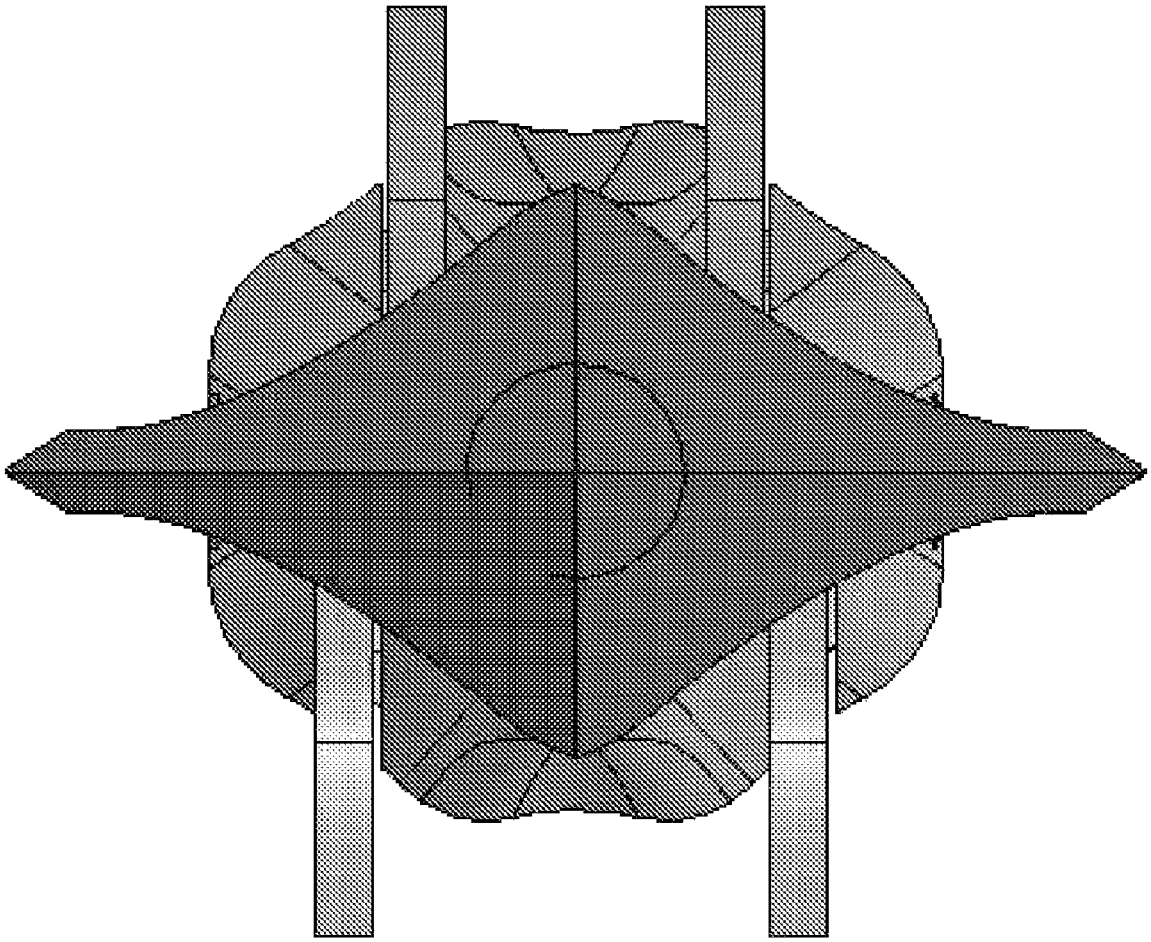
FIG. 8 is a front plan view of the arrowhead of FIG. 1, with the expandable blades shown in the closed position.

The blades 16, 17, 18 and 19 are affixed to the support body 12, by an appropriate fastener 23, such as a screw or roll pin. A separate fastener 23 is used on each side of the support body 12. The fastener 23 passes through one side of the support body 12, and also passes through the pre-drilled holes 53 of the expandable blades 16, 17, 18 and 19. The fastener 23 provides the pivot point upon which the expandable blades move. Two of the blades 16 and 17 may be attached to the support body 12 with a single fastener 23, and may be displaced from one another for that purpose, as shown in FIG. 8. Similarly, the other two blades 18 and 19 may be fastened to the support body 12 using a second fastener 23 on the other side of the support body.

Opposed pairs of the slots 28, 30, and 29, 31 may respectively connect to one another within the support body 12, the rounded ends of the expandable blades 16, 17, 18 and 19 may be placed overlapping one another.

The arrowhead 10 also includes the fixed blade 14, which is rigidly attached to the support body 12 adjacent the tip 26 thereof. The fixed blade 14 includes a base portion which is substantially continuous and uninterrupted, as shown in FIG. 2. In the depicted embodiment, the fixed blade 14 is substantially diamond-shaped, with one endpoint truncated, as shown, and with a longitudinally central portion thereof being wider than medial edge portions. Optionally, the fixed blade 14 may either be integrally formed with the support body as a unitary member, or may be formed separately and affixed to the support body in any suitable fashion known in the art.

Figure 7:
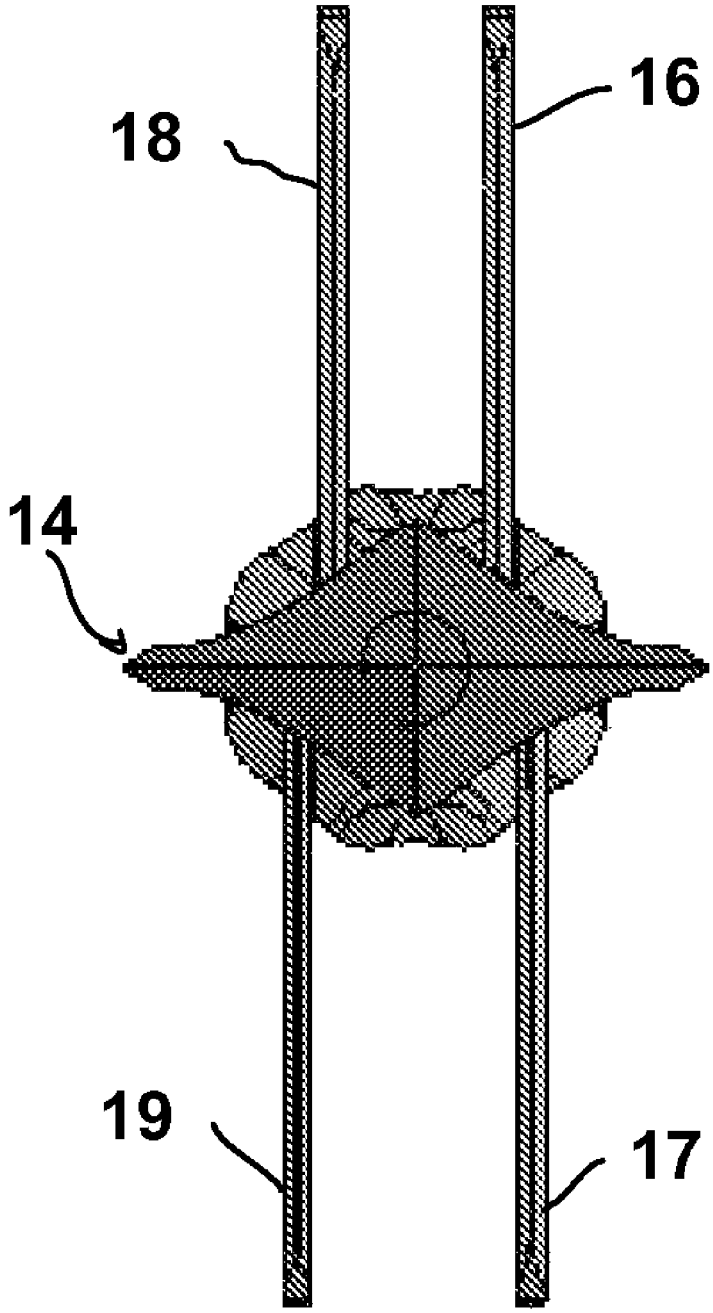
FIG. 7 is a front plan view of the arrowhead of FIG. 1, with the expandable blades shown in the open position.

Also in this embodiment, each cutting edge at the forward end of each of the blades is sharpened on both sides thereof, as shown in FIG. 7. The fixed blade 14 may be made of stainless steel and may have a pre-drilled hole formed therethrough for purposes of attachment. The fixed blade 14 attaches to the support body 12, by placing the base portion thereof into the central slot 29 at the front of the support body 12. The fixed blade 14 is attached to the support body using an appropriate fastener such as a screw 27, which passes through one side of the support body 12, slides through the pre-drilled hole 40 in the fixed blade 14, and continues being threaded through the support body 12, without reaching the opposing side, due to its carefully selected length.

Although a selected illustrative embodiment of the present invention has been described with specificity herein, the foregoing description is intended to be an illustration, and not a restriction in the scope of the invention. Those skilled in the art will realize that many modifications of the embodiment could be made which would be operable.

What is claimed is:

1. An arrowhead for securement to one end of an arrow, comprising;

a support body having a base and a tip, the tip being opposite the base;

at least one fixed-position blade attached to the tip of said support body;

at least four expandable blades movably attached to the support body; said expandable blades having cutting edges formed on leading edges thereof, a first pair of the expandable blades being substantially parallel and non-planar to each other and a second pair of the expandable blades being substantially parallel and non-planar to each other; the expandable blades being movable between a first retracted position, in which said cutting edges are disposed in slots of said support body, and a second open position in which the expandable blades extend outwardly from said support body with said cutting edges exposed;

wherein the first pair of expandable blades extend laterally outwardly from the support body in a first direction, and the second pair of expandable blades extend laterally outwardly from the support body in a second direction.

2. The arrowhead of claim 1, wherein the at least one fixed-position blade comprises a diamond-shaped double-edged fixed blade.

3. The arrowhead of claim 1, wherein each of the fixed-position blades comprises a replaceable blade.

4. The arrowhead of claim 1, wherein the expandable blades comprise two pairs of parallel and non-planar blades and the body has at least one pair of parallel slots formed therein.

5. The arrowhead of claim 1, wherein each expandable blade includes a spur formed at a first end thereof, each spur being located at the leading edge of the respective expandable blade when in the retracted position and each spur is positioned adjacent the fixed blade.

6. The arrowhead of claim 5 wherein each spur is configured to impact the target during use and force the expandable blades rearwardly to orient the cutting edges to face forwardly.

7. The arrowhead of claim 4 wherein the cutting edges of the expandable blades are semi-concealed within the slots in the support body when in the retracted position.

8. The arrowhead of claim 1 wherein each of the expandable blades includes a rounded portion and a flat portion at the first end thereof, the rounded portion enabling fast deployment of the blades the flat portion defining a stop to limit the rearward motion of the associated expandable blade when it hits a target.

9. The arrowhead of claim 1 wherein the expandable blades are secured to the body with fasteners.

10. An arrowhead for attachment to an arrow shaft, the arrowhead including a fixed blade portion, a movable blade portion, and a support body, the arrowhead comprising:

the support body having a first end and a second end, the second end having an attachment portion for securing the arrowhead to the arrow shaft, the first end having the fixed blade portion mounted thereto and integrally formed therewith;

the support body further having two pairs of parallel slots between the fixed blade and the second end; and the movable blade portion having at least two pairs of parallel non-planar movable blades having cutting edges, each movable blade having a first end attached to the support body in the slot adjacent the second end of the body, each of the movable blades fitting into an associated slot, each movable blade having a spur that moves with the blade from a first retracted position adjacent the fixed blade when the movable blades are in the slots and a second position wherein the spurs are spaced from the body exposing the cutting edges of each of the movable blades;

wherein a first pair of the movable blades extends laterally outwardly from the body in a first direction when moving from the first position to the second position, and a second pair of the movable blades extends laterally outwardly from the body in a second direction when moving from the first position to the second position, the first and second directions being substantially opposite each other.

11. The arrowhead of claim 10 wherein the fixed blade is diamond-shaped replaceable blade.

12. The arrowhead of claim 10 wherein the spurs define aerodynamic stabilizers.

13. The arrowhead of claim 10 wherein the spurs impact the target forcing the movable blades rearwardly to orient the cutting edges of the movable blades facing forwardly.

14. The arrowhead of claim 10, wherein the retracted position when the spurs are adjacent the fixed blades allows the safe handling of the arrowhead since the sharpened edges on the movable blades are concealed in the slots in the support body.

15. The arrowhead of claim 10, wherein each of the movable blades comprise an elongate blade member having a first end with the spur and a second end having a pivot point, the pivot point secured to the body, and the second end further having a flat portion to limit the rearward movement of the movable blade.

16. The arrowhead of claim 15 wherein at least two of the movable blades are pivotally fastened to the support body with a single screw.

17. The arrowhead of claim 15, wherein each of said movable blades is pivotally secured to the support body with a fastener.

18. The arrowhead of claim 15, wherein the pivot point acts as a fulcrum on which the movable blades pivot to the deployed position.

19. A method for hunting a game animal comprising:

shooting the game animal with an arrow comprising an arrowhead secured to an arrow shaft, the arrowhead comprising:

a body, and at least two pair of parallel spaced apart cutting blades, the blades of the first pair movably secured to the body and extending laterally outward from the body in a first direction, the blades of the second pair movably secured to the body and extending laterally outwardly from the body in a second direction different from that of the first pair of blades, the space between the blades of the first pair and the blades of the second pair blades cooperate to form an enlarged wound opening when both pairs are fully extended.

20. The method of claim 19 wherein the body includes a fixed-position blade which is integrally formed with the body.

* * * * *